US006447230B1

(12) United States Patent
Takai et al.

(10) Patent No.: US 6,447,230 B1
(45) Date of Patent: Sep. 10, 2002

(54) BOOK BINDING SYSTEM

(75) Inventors: Shinichi Takai, Shiga; Yoshiyuki Horii, Kyoto; Shozo Itadori, Shiga; Shigenobu Fukuda, Kyoto, all of (JP)

(73) Assignee: HOrizon International Inc., Shiga (JP)

( * ) Notice: Subject to any disclaimer, the term of this patent is extended or adjusted under 35 U.S.C. 154(b) by 0 days.

(21) Appl. No.: 09/657,607

(22) Filed: Sep. 8, 2000

(30) Foreign Application Priority Data

Sep. 10, 1999 (JP) ..... 11-256542

(51) Int. Cl.[7] ..... B42C 13/00

(52) U.S. Cl. ..... 412/14; 270/52.08; 412/9; 412/19

(58) Field of Search ..... 412/9, 1, 3, 4, 412/11, 14, 18, 19; 270/52.01, 52.08, 58.09, 58.12

(56) References Cited

U.S. PATENT DOCUMENTS

| | | | | | |
|---|---|---|---|---|---|
| 4,075,726 | A | * | 2/1978 | Korsgaard | 11/1 R |
| 4,767,250 | A | | 8/1988 | Garlichs | 412/11 |
| 5,876,170 | A | * | 3/1999 | Geiser | 412/8 |
| 6,158,940 | A | * | 12/2000 | Nehring | 412/9 |
| 6,168,363 | B1 | * | 1/2001 | Nehring | 412/30 |
| 6,171,045 | B1 | * | 1/2001 | Nehring et al. | 412/30 |
| 6,189,879 | B1 | * | 2/2001 | Conner et al. | 270/52.15 |
| 6,196,537 | B1 | * | 3/2001 | Conner et al. | 270/52.15 |

FOREIGN PATENT DOCUMENTS

| | | |
|---|---|---|
| EP | 0 895 872 A | 2/1999 |

* cited by examiner

*Primary Examiner*—A. L. Wellington
*Assistant Examiner*—Monica Carter
(74) *Attorney, Agent, or Firm*—Armstrong, Westerman & Hattori, LLP

(57) ABSTRACT

On a base (12) are fixed a pair of supporting members (6, 8). A guide rail (3) is supported by the pair of supporting members. A measurement block (2) is guided by the guide rail in a sliding manner. On the base is fixed a reference block (10) abutted by the measurement block when it has reached one end of the guide rail. A moving-distance measuring device is provided which uses as a zero point a position where the measurement block abuts against the reference block, to measure a distance over which the measurement block has moved with respect to the reference block. The moving-distance measuring device has, on the base, a pair of pulleys (5, 7) arranged with a gap therebetween in a direction parallel to the guide rail, a belt (4) engaged over the pair of pulleys and having its part linked with the measurement block, and a rotary encoder (11) linked to a rotary shaft of one of the paired pulleys. By sandwiching predetermined portions of a book block and a book cover between the reference block and the measurement block, the size can be measured and thus obtained measurement values are input from the measuring device to a controller device. The controller device, based on these measurement values, controls the carrier mechanism and the processing units of the book binding system.

5 Claims, 6 Drawing Sheets

BOOK BINDING SYSTEM

BACKGROUND OF THE INVENTION

1. Technical Field

The present invention relates to improvements of a book binding system performing book binding process for binding book blocks together with book covers so as to make books or booklets. The book binding system comprises a carriage passage, a carrier mechanism for carrying the book block along the carriage passage, and a series of processing units which are sequentially provided along a carriage line, to perform the book binding process. The carrier mechanism has a clamp-adjustment mechanism for adjusting a gap for clamping the book blocks and the processing units each have at least one of an acting-portion adjustment mechanism and an alignment mechanism. The clamp-adjustment mechanism and the acting-portion adjustment mechanism and the alignment mechanism are adjusted to accommodate the book blocks and the book covers of various sizes.

2. Description of the Related Art

Recently, such book binding system has been developed that can receive one volume of book blocks consecutively from a printer or a copy machine to book-bind each of the book blocks one after another. FIG. 8 is a plan view showing a schematic configuration of such a prior-art book binding system. The book binding system shown in FIG. 8 is of a wireless stitch-binding type and comprises: a carriage passage F; a carrier mechanism (clamper having a pair of clamp plates Ab and Ac) for clamping a book block P to carry it along the carriage passage F; and a series of processing units (processing starting unit A, milling unit B, pasting unit C, and book-covering unit D) sequentially provided along the carriage passage F for performing book binding processes.

At the processing starting unit A, the book block P is position with its back side put on a level plate Aa and, with this, one of the clamp plates, Ab, is moved in an arrow Ra direction corresponding to a thickness of the book block P, thus appropriately adjusting the gap between the pair of clamp plates Ab and Ac. Then, the book block P is sandwiched between the pair of clamp plates Ab and Ac and sent along the carriage passage to the milling unit B for the next process.

The milling unit B comprises a milling cutter Ba and a pair of width adjusting plates Bb and Bc. At the milling unit B, one of the width adjusting plates, Bb, is moved in an arrow Rb direction, to adjust the gap between the pair of the width adjusting plates Bb and Bc. As the book block P sandwiched between the pair of clamp plates Ab and Ac passes over the milling cutter Ba, the back side of the book block P is cut to the same level, thus being pre-processed for applying paste uniformly to the whole back side. A certain type of the milling unit B may have a blade for forming a small groove in the back side of the book block P to pate it better.

Next, the book block P sandwiched between the pair of clamp plates Ab and Ac is sent to the pasting unit C. The pasting unit C comprises a paste tank Ca for containing paste, a paste roller Cb, and a roller Cc for wiping extra paste, so as to apply paste on the back side of the book block P to an appropriate thickness. When pasting is completed, the book block P is sent to the book-covering unit D.

At the book-covering unit D, a printed book cover Q is carried by a conveyor or any other appropriate carriage means from a book-cover accumulating portion (not shown) in an arrow S direction onto a bottom plate Da and nip plates Db and Dc. One of the nip plates, Db, is moved in an arrow Rc direction corresponding to the thickness of the book block P, to adjust the gap between the pair of nip plates Db and Dc. Then, the back side of the book cover is adhered to the back side of the book block P thus carried over as sandwiched between the pair of clamp plates from the pasting unit C.

In this case, however, to adhere the book cover Q to the book block P, proper alignment is necessary so that the centerline of the back side of the book cover Q may agree with that of the back side of the book block P. FIG. 9 is a plan view explaining one exemplified method of aligning the book cover Q and FIG. 10, a plan view as viewed in an arrow X direction of FIG. 9.

As shown in FIGS. 9 and 10, the plurality of book covers Q are stored between a right-side guide plate 51 and a left-side guide plate 54. When a right-side guide-plate moving motor 52 is driven, a linkage portion 51*a* moves along a right-side guide-moving screw 53 in an arrow direction Tc, to thus moving also the right-side guide plate 51 linked to the linkage portion 51*a* in the arrow direction Tc.

When a left-side guide-plate moving motor 55 is driven, a linkage portion 54*a* moves along a left-side guide-moving screw 56 in an arrow direction Td, thus moving also the left-side guide plate 54 linked to the linkage portion 54*a* in the arrow Td direction. Thus, when the right-side guide-plate moving motor 52 or the left-side guide-plate moving motor 55 is driven, the book cover Q moves in the arrow Ta direction, to align the centerline of the back side Qa with that of the back side of the book block P sandwiched between the clamp plates A and Ac.

A reference number 57 represents a vertical guide plate for setting a top-and-bottom (vertical) reference position of the book cover, a reference numeral 58 represents a vertical guide-plate moving motor, and a reference numeral 59 represents a vertical guide-moving screw. When the vertical guide-plate moving 58 is driven, the vertical guide plate 57 moves from its home position in an arrow Tb direction. The vertical guide plate 57, when the vertical guide-moving motor 59 is rotated in a reverse direction, returns to the home position. A reference numeral 60 represents a frame body for fixing the motors 52, 55, and 58 and a reference numeral 60*a*, a support portion for supporting a left-side moving screw 53 and a left-side guide-moving screw 56.

The right-side guide-plate moving motor 52, the left-side guide-plate moving motor 55, and the vertical guide-plate moving motor 58 consist of, for example, a stepping motor. With this, a move is determined on the basis of measurement values of a width-wise size, a length-wise size, and a back-side centerline position of the book cover.

Also, as mentioned above, it is necessary to, corresponding to the thickness of the book block P, adjust the gap between the pair of clamp plates Ab and Ac of the processing starting unit A, the gap between the width adjusting plates Bb and Bc of the milling unit B, and the gap between the pair of the nip plates Db and Dc of the book-covering unit D, that is, it is necessary to adjust the respective width-adjusting portions of these units. The gaps of these members are adjusted either by the operator manually or by the motor, which is used to move these members over an appropriate distance.

Thus, the prior-art book binding system measures the thickness of the book block P and the size of the book cover Q at their respective predetermined portions, based on measurement values obtained by which are adjusted the respective width-adjusting portions of the processing units either by the manual operations or by the motor-driven operations. Also, by the motor-driven operations, the book-cover alignment mechanism is adjusted. In this case, in motor-driven adjustment, the operator would enter measurement values at the key-in portion of the controller device, thus setting a move.

Therefore, it is necessary to measure the size and adjust the respective width-adjusting mechanisms of the processing units or to enter necessary values for motor-driven operations, to increase working loads, thus problematically prolonging the time required in book binding.

Also, there may be some cases where a book is bound with the centerline of the book block back side as misaligned with that of the book-cover back side. In such a case of a failure in book binding, book covering must performed again in order that the centerline of the book-cover back side may agree with that of the book-block back side, which further increases the working loads, thus further prolonging the time for book binding.

SUMMARY OF THE INVENTION

In view of the above, it is an object of the present invention to provide a book binding system that can accommodate book blocks and book covers of various sizes, to reduce the working loads of width adjustment and alignment of various processing units of the system as well as to improve the book binding efficiency.

In order to achieve this object, according to the present invention there is provided a book binding system performing book binding process for binding book blocks together with book covers so as to make books or booklets. The book binding system has a carriage passage, a carrier mechanism for clamping the book blocks and carrying the book blocks along the carriage passage, and a series of processing units sequentially provided along the carriage passage for performing the book binding process, the carrier mechanism including a clamp-adjustment mechanism for adjusting a gap for clamping book blocks and the processing units each including at least one of an acting-portion adjustment mechanism and an alignment mechanism, the clamp-adjustment mechanism, and the acting-portion adjustment mechanism and the alignment mechanism being adjusted to accommodate the book blocks and the book covers of various sizes. The book binding system further comprises a measuring device for measuring the size of the book blocks and the book covers at their respective predetermined portions and outputting the measurement value, and a controller device for receiving the measurement values from the measuring device and, based on the measurement values, adjusting the clamp-adjuring mechanism of the carrier mechanism and the acting-portion adjustment mechanism and alignment mechanism of each of the processing units.

According to a preferred embodiment of the invention, the measuring device has a base, a pair of supporting members fixed on the base with a gap therebetween, a guide rail extending between the pair of supporting members and supported by the supporting members, a measurement block guided for slide movement by the supporting member, a reference block fixed on the base and abutted by one end of the guide rail, and moving-distance measuring means for using as a zero-point a position where the measurement block butts against the reference block to thereby measure a distance over which the measurement block has moved with respect to the reference block, wherein the predetermined portions of the book blocks and book covers are sandwiched between the reference and the measurement block, to measure the size and output the measurement value from the measuring device.

According to another preferred embodiment of the invention, the abutting surfaces of the reference block and the measurement block each consist of a flat measuring surface and the predetermined portions of the book blocks and book covers are sandwiched between the reference block and the measurement block, thus enabling the measurement of the size.

According to further preferred embodiment of the invention, the moving-distance measuring means has; on the base, a pair of pulleys arranged with a gap therebetween in a direction parallel to the guide rail, a belt engaged over the pair of pulleys and having its part linked with the measurement block, and outputting means linked to the rotary shaft of one of the pair of pulleys for measuring the number of rotations of the pulley and converting the number of rotations into a moving distance of the measurement block and then outputting the moving distance.

According to further preferred embodiment of the invention, the measuring device has a display portion for displaying the measurement value and a numeric value input portion for inputting the numeric value displayed at the display portion, or changing the numeric value and then inputting the changed numeric value, wherein before the size is measured, the measurement block is abutted against the reference block, whereupon, the numeric value zero is input through the numeric value input portion so as to perform zero-point correction.

According to further preferred embodiment of the invention, the measuring device has a display portion for displaying the measurement value and a numeric value input portion for inputting the numeric value displayed at the display portion, or changing the numeric value and then inputting the changed numeric value, wherein before the size is measured, the measurement block is abutted against the reference block, whereupon, the numeric value zero is input through the numeric value input portion, and then the measurement block is moved by the maximum moving distance, the numeric value of which is previously known, whereupon, the known numeric value is input through the numeric value input portion so as to perform the calibration of the measuring device.

According to further preferred embodiment of the invention, the predetermined portion of the book block comprises a thickness of the book block and either a position of the centerline of a back portion of the book cover or a position of each side edges of the back portion, wherein the clamp-adjustment mechanism of the carrier mechanism as well as the acting-portion adjustment mechanism and alignment mechanism of each of the processing units are controlled so that the centerline of the back side of the book cover may agree with that of the back side of the book block.

DESCRIPTION OF THE PREFERRED EMBODIMENTS

The following will describe preferred embodiments of the present invention with reference to the accompanying drawings. The book binding system according to one embodiment of the invention has basically the same configuration as that shown in FIG. 8. That is, the book binding system comprises a carriage passage F, a carrier mechanism (clamper consisting of a pair of clamp plates Ab and Ac) for clamping a book block P and carrying it along the carriage passage F, and a series of processing units (for example, processing starting unit A, milling unit B, pasting unit C, and book covering unit D) sequentially provided along the carriage passage F for performing book binding processes. The carrier mechanism is provided with a clamp-adjustment mechanism for adjusting a gap for clamping the book block P and the processing units each have at least one of an acting-portion adjustment mechanism and an alignment mechanism, thus accommodating the book block P and the book cover Q of various sizes.

Figure 8:
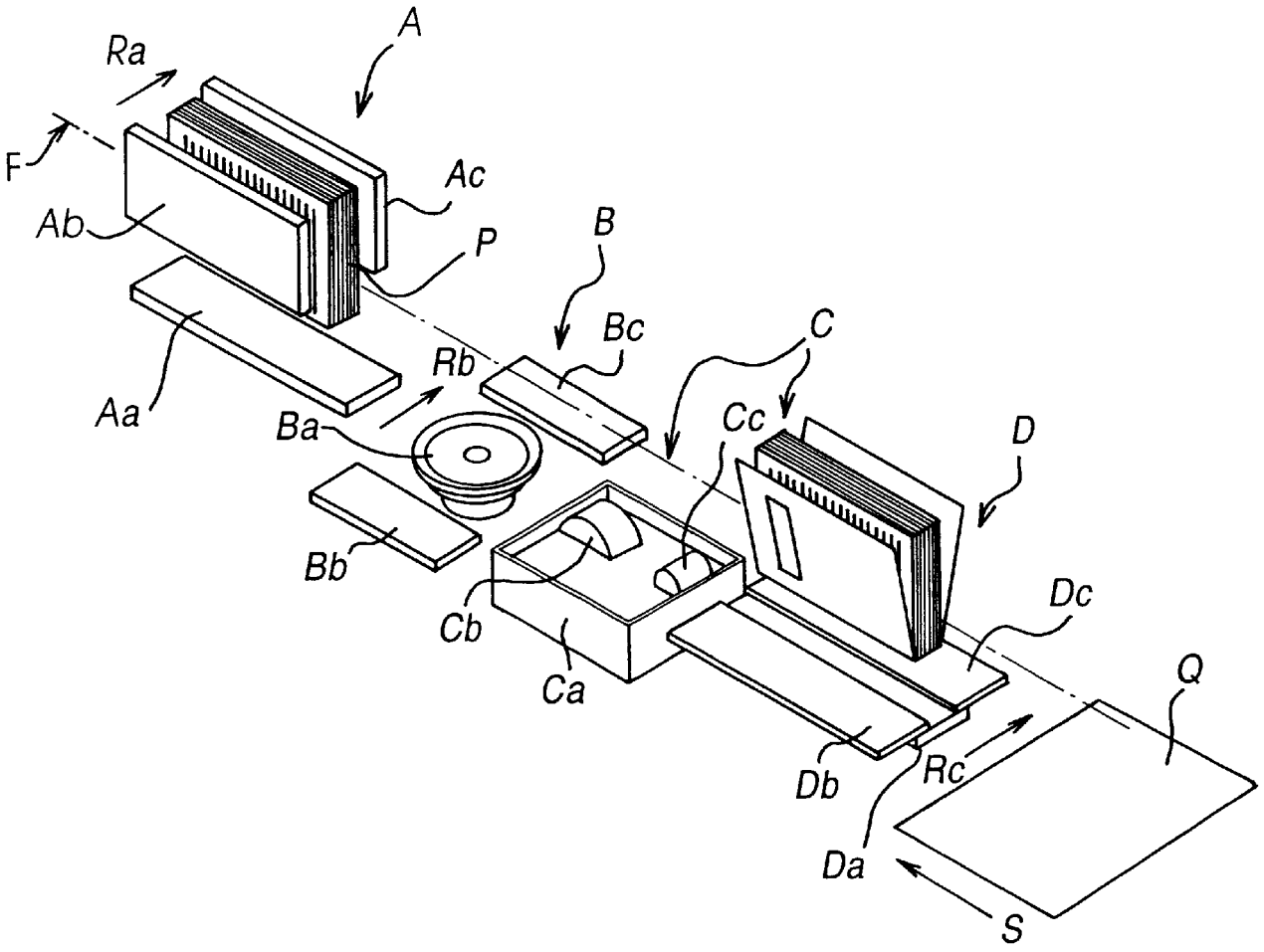
FIG. 8 PRIOR ART
FIG. 8 is an illustration showing a schematic configuration of one example of the book binding system.
Figure 9:
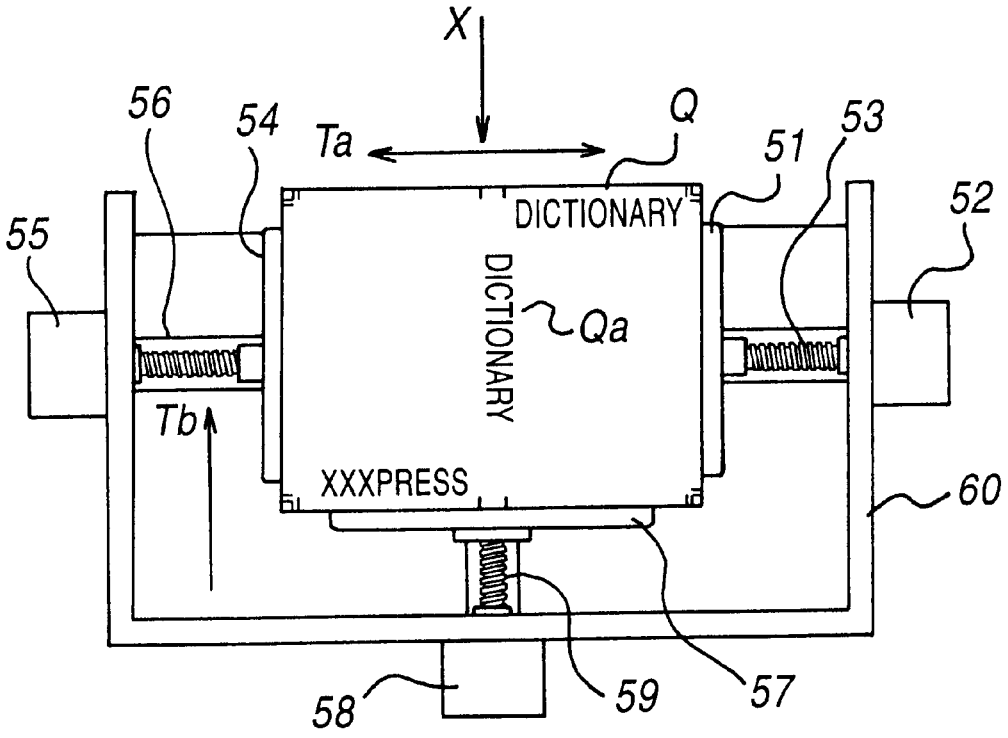
FIG. 9 PRIOR ART
FIG. 9 is a plan view explaining a method for aligning the book cover.
Figure 10:
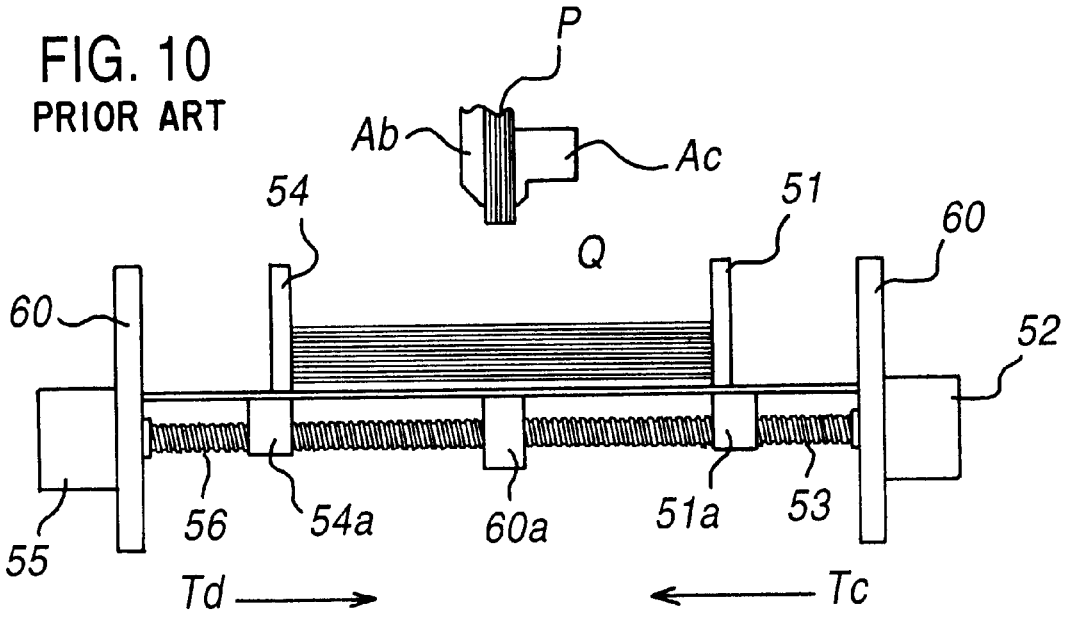
FIG. 10 PRIOR ART
FIG. 10 is a plan view as viewed in an arrow X direction of FIG. 9.

In addition to the configuration shown in FIG. 8, the book binding system of the invention further comprises a measuring device for measuring the size of the book block P and the book cover Q at their respective predetermined portions and outputting measurement values and a controller device for receiving the measurement values from the measuring device and, based on these values, controlling the clamp-adjustment mechanism of the carrier mechanism as well as the acting-portion adjustment mechanism and the alignment mechanism of each of the processing units.

Figure 1:
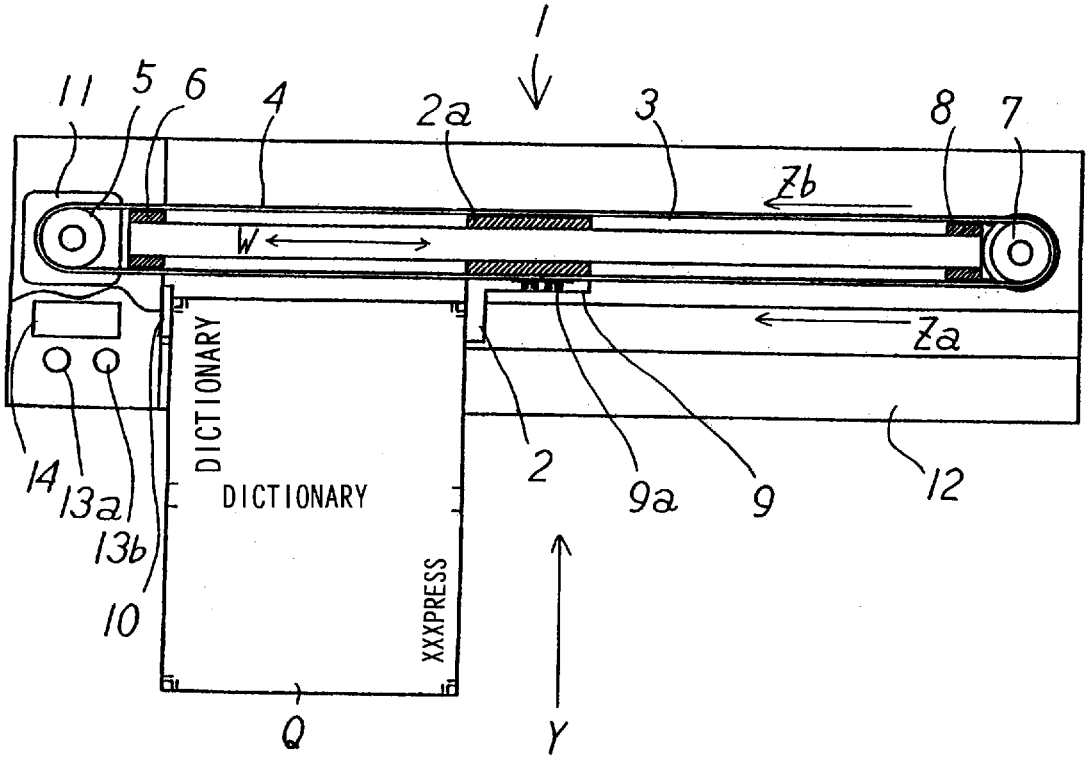
FIG. 1 is a partially broken plan view showing a schematic configuration of a measuring device applied to a book binding apparatus according to one embodiment of the invention.
Figure 2:
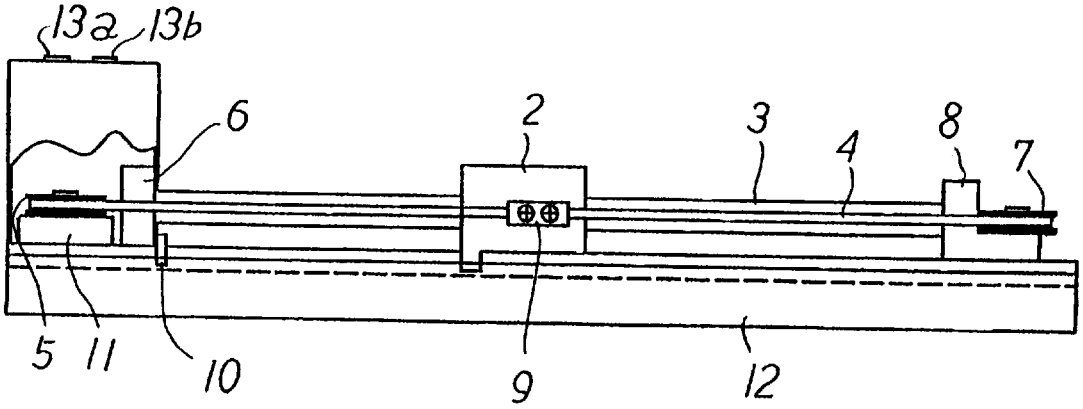
FIG. 2 is a plan view as viewed in an arrow Y direction of FIG. 1.

FIG. 1 is a partially broken plan view showing a schematic configuration of the measuring device equipped to the book binding system of the invention. FIG. 2 is a plan view as viewed in the arrow X direction of FIG. 1.

As can be seen from FIGS. 1 and 2, a measuring device 1 comprises a base 12, a pair of supporting members 6 and 8 fixed on the base 12 with a gap therebetween, and a straight guide rail 3 extending between the pair of supporting members 6 and 8 and supported thereby. The measuring device 1 has also a measurement block 2 guided in a sliding manner by the guide rail 3. The measurement block 2 has a through-hole 2*a* therein, through which the guide rail 3 passes, to engage the measurement block with the guide rail 3.

The measuring device 1 further has a reference block 10 abutted by the measurement block 2 when it reaches one end of the guide rail 3. The abutting surfaces of the reference block 10 and the measurement block 2 each consist of a flat measuring surface.

The measuring device 1 further has a moving-distance measuring device for using as a zero-point a position where the measurement block 2 abuts against the reference block 10, to measure a distance over which the measurement block 2 has moved with respect to the reference block 10. The moving-distance measuring device has, on the base 12, a pair of pulleys 5 and 7 arranged with a gap therebetween in a direction parallel to the guide rail 3, and a belt 4 engaged over the pair of pulleys 5 and 7. This pair of pulleys 5, 7 are each arranged so as to be rotational around a vertical axis. Part of the belt 4 is linked to a measurement block 2 at a linkage portion 9 by use of a screw 9*a*. The moving-distance measuring device further has an output device, for example a rotary encoder 11, which is linked to the rotary shaft of one of the pulleys, the pulley 5, to measure the number of rotations and convert this number of rotations into a moving distance of the measurement block 2 and then placing it as an output.

Thus, by the predetermined portions of the book block P and the book cover Q between the measuring surface of the reference block 10 and that of the measurement block 2, the size can be measured and output from the measuring device 1 as measurement values.

The measuring device 1 further has a power-source switch 13*a*, a display portion 14 for displaying measurement values, and a numeric value input switch 13*b* for inputting of the numeric value (measurement value) displayed at the display portion 14, or changing that numeric value and inputting the changed numeric value.

To obtain a correct measurement value by preventing the occurrence of a measurement error due to the contraction and expansion of the belt 4, before the size is measured, the measurement block 2 is abutted against the reference block 10, whereupon, the numeric value zero is input through the numeric value input switch 13*b* so as to perform the zero-point correction. Alternatively, before the size is measured, the measurement block 2 is abutted against the reference block 10, whereupon, the numeric value zero is input through the numeric value input switch 13*b*, and then the measurement block 2 is moved by the maximum moving distance, the numeric value of which is previously known, whereupon the known numeric value is input through the numeric value input switch 13*b* so as to perform the calibration of the measuring device 1.

This size is measured as follows. FIG. 1 explains how to measure the size of the book cover Q. As can be seen from FIG. 1, after the zero-point correction or the calibration of the measuring device 1, one side surface of the book cover Q is abutted against the measuring surface of the reference block 10 and the measurement block 2 is slid in an arrow Zb direction so as to abut against the other side surface. As the measurement block 2 slides, the belt 4 moves in the arrow Za direction or the arrow Zb direction, so that a rotary encoder 11 outputs a distance over which the measurement block 2 has moved, which is then sent to the display portion 14. When a numeric value input switch 13*b* is pressed, the measurement value is input to the controller device.

Figure 3:
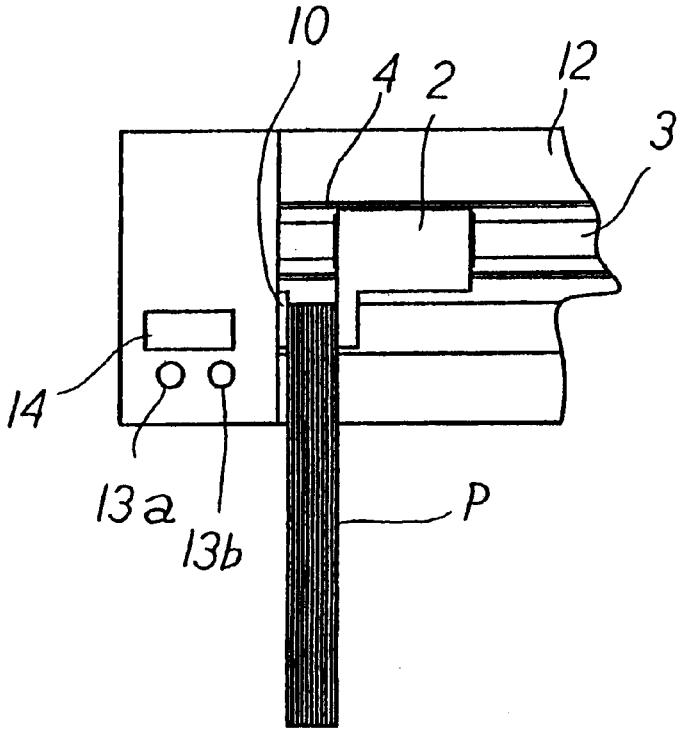
FIG. 3 is a plan view explaining a method for measuring a thickness of the book block.

FIG. 3 is a plan view explaining how to measure the thickness of the book block P using a measuring device shown in FIG. 1. In this case, after the measuring device is subjected to the zero-point correction or the calibration of the measuring device 1, one side surface of the book block P is abutted against the measuring surface of the reference block 10 and the measurement block 2 is slid along the guide rail 3, thus abutting the measuring surface of the measurement block 2 against the other side surface of the book block P. A measurement value obtained is displayed at the display portion 14.

Figure 4:
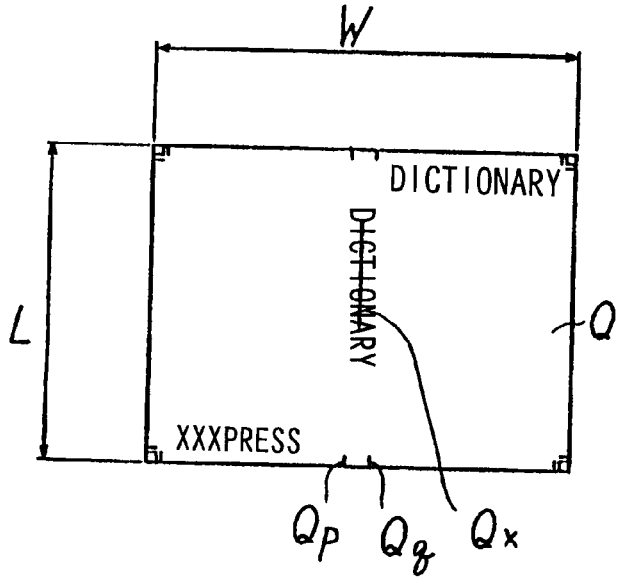
FIG. 4 is a plan view showing a point at which the book cover is measure.

FIG. 4 is a plan view showing an example of the measuring positions of the book cover Q. L represents the top-and-bottom directional (length-directional) size, W represents the width-directional size, and Qp and Qq represent respective marks, called "dragonfly," specifying the book-cover folding positions. Qx represents a size from one end of the book cover Q to the center of the back portion of the book cover.

Figure 5:
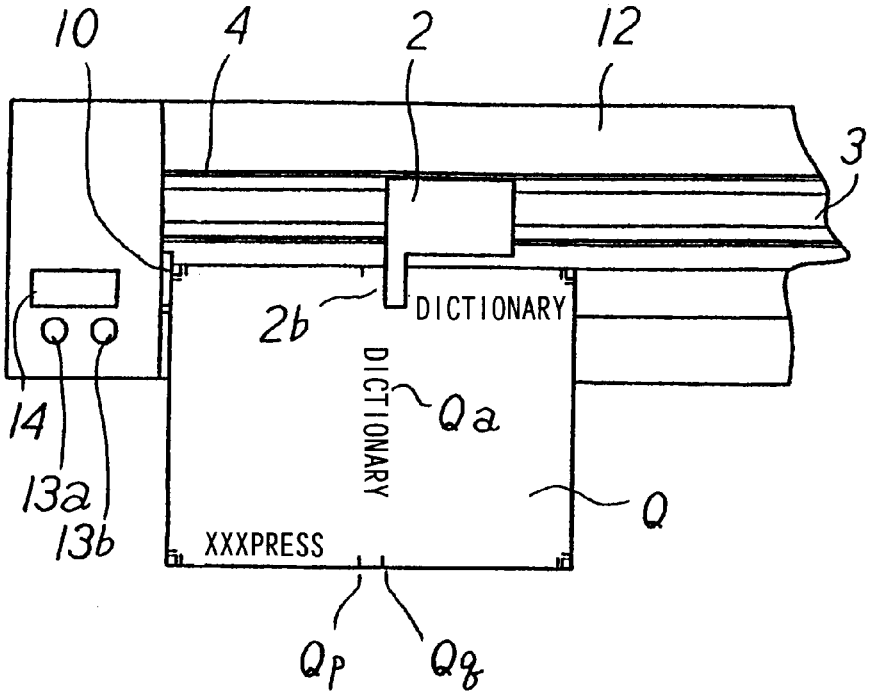
FIG. 5 explains a method for measuring a width of the back side of the book cover.
Figure 6:
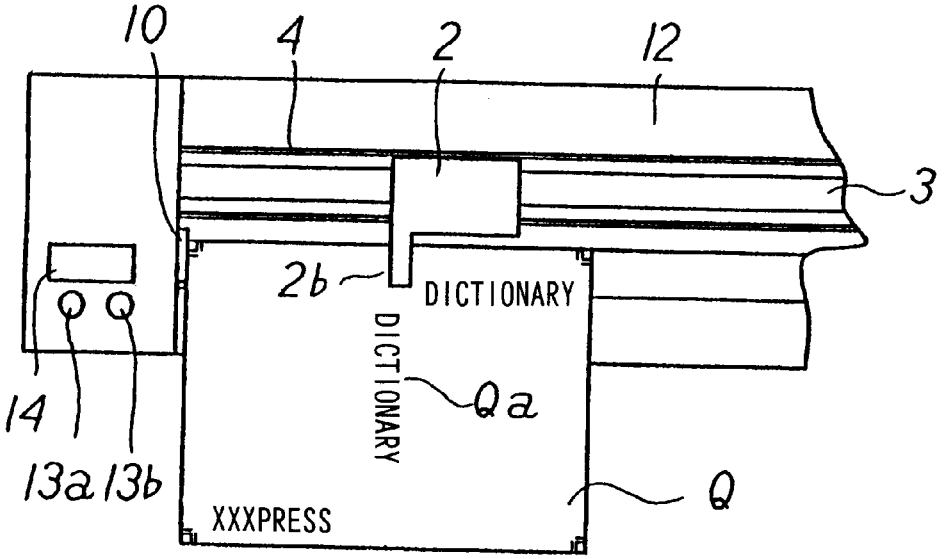
FIG. 6 is a plan view explaining a method for measuring a position of the centerline of the back side of the book cover.

FIGS. 5 and 6 explain how to measure the position of the "dragonfly" attached to the book cover. In FIG. 5, the book cover Q has attached thereto the marks Qp and Qq corresponding to the width (folding position) of the back portion, so that the width of the back portion of the book cover Q can be determined on the basis of measurement values obtained when the measuring surface 2*b* of the measurement block 2 is placed at the position of the respective marks Qp and Qq.

In FIG. 6, one side surface of the book cover Q is abutted against the reference block 10 to determine a reference position, so that the position of the centerline of the back title can be determined on the basis of measurement values obtained when the measuring surface of the measurement block 2 is placed at the position of the back title "DICTIONARY".

Figure 7:
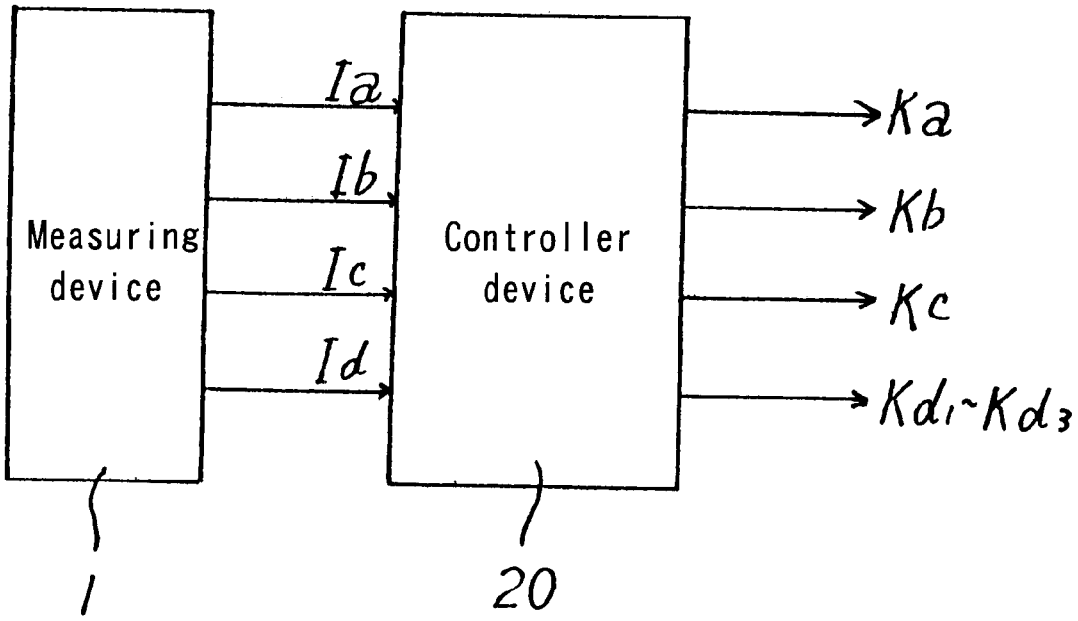
FIG. 7 is a block diagram showing operations of the controller device.

FIG. 7 is a block diagram showing the operations of the controller device equipped to the book binding system according to the invention. As described above, the measuring device 1 receives measurement values of Ia of the thickness of the book block P, Ib of the vertical size of the book cover Q, Ic of the width size of the book cover Q, and Id of the width size of the back portion of the book cover Q and then outputs these measurement values to the controller device 20.

The controller device 20 comprises a central processing unit (CPU), ROMs and RAMs, and an interface. The controller device 20 receives measurement values from the measuring device 1 and, based on these measurement values, outputs control signals to the clamp-adjustment mechanism of the carrier mechanism and the acting-portion adjustment mechanism and the alignment mechanism of each of the processing units.

These control signals are specifically a control signal Ka for adjusting the gap between the clamper's clamp plates, a control signal Kb for adjusting the gap between the width adjusting plates of the milling unit, a control signal Kc for adjusting the gap between the nip plates, and control signals Kd1 to Kd3 for aligning the book cover. Of these, the control signals Kd1, Kd2, and Kd3 are provided to adjust the right-side guide plate, the left-side guide plate, and the top-and-bottom guide plate respectively.

When these signals are input from the controller device 20 to the clamp-adjustment mechanism of the carrier mechanism and the acting-portion adjustment mechanism and the alignment mechanism of each of the processing unit, the corresponding solenoid, the motor, and other driving devices are actuated under control. Note here that the controller device 20 outputs also other signals such as those for controlling the clamper's moving speed, the number of revolutions of the milling cutter driving motor, etc.

Although in the book binding system according to this embodiment, as shown in FIG. 8, the processing units are arranged straightly so as to move the damper straightly, the invention is not limited thereto but may be applied to such a configuration of the book binding system that a chain is engaged over sprockets arranged on the opposite sides of the carriage passage so that the damper mounted to the chain may circulate along the processing units.

Thus, according to the invention, when the measuring device 1 measures the size of the predetermined portions of the book block P and the book cover Q, thus obtained measurement values are input to the controller device 20, based on which measurement values the controller device 20 automatically controls the clamp-adjustment mechanism of the carrier mechanism and the acting-portion adjustment mechanism and the alignment mechanism of each of the processing units of the book binding system. With this, the manual works by the operator can be rendered unnecessary such as manual adjustment and key-in operations, to reduce the working loads with the book binding process and remarkably improve the book binding efficiency.

Also, according to the invention, by sandwiching the predetermined portions of the book block P and the book cover Q between the reference block 10 and the measurement block 2 which reciprocates straightly with respect to the reference block 10, the size is measured, thus making it possible to obtain correct measurement values. Further, zero-point correction or the calibration of the measuring device 1 is conducted before the size is measured by the measuring device 1, it is possible to prevent the occurrence of an error in measurement due to the contraction and expansion of the belt 4, thus providing more correct measurement of the size. In addition, the books are not bound with the centerline of the back portion of the cook cover misaligned with that of the back portion of the book block, thus preventing the occurrence of faulty book binding.

What is claimed is:

1. A book binding system for binding book blocks together with book covers so as to make books or booklets, the book binding system having a carriage passage, a carrier mechanism for clamping the book blocks and carrying the book blocks along the carriage passage, and a series of processing units sequentially provided along the carriage passage for performing the book binding process, wherein the carrier mechanism has a clamp-adjustment mechanism for adjusting a gap for clamping the book blocks and the processing units each having at least one of an acting-portion adjustment mechanism and an alignment mechanism, the clamp-adjustment mechanism, and the acting-portion adjustment mechanism and the alignment mechanism being adjusted to accommodate the book blocks and the book covers of various sizes, wherein said book binding system comprises:

a measuring device for measuring the size of the book blocks and the book covers at their respective predetermined portions and then outputting thus obtained measurement values; and a controller device for receiving the measurement values from the measurement device and, based on the measurement values, adjusting the clamp-adjustment mechanism of the carrier mechanism and the acting-portion adjustment mechanism and the alignment mechanism of each of the processing units;

a base;

a pair of supporting members fixed on the base with a spacing therebetween;

a guide rail extending between the pair of the supporting members and supported by the supporting members;

a measurement block guided by the guide rail for slide movement;

a reference block fixed on the base and abutted by the measurement block when the measurement block reaches one end of the guide rail; and moving-distance measuring means for using as a zero point a position where the measurement block abuts against the reference block, to measure a distance over which the measurement block has moved with respect to the reference block, wherein by sandwiching the predetermined portions of the book block and the book cover between the reference block and the measurement block, the size is measured and thus obtained measurement values are then output from the measuring device;

wherein the moving-distance measuring means comprises:

a pair of pulleys arranged on the base with a spacing therebetween in a direction in parallel to the guide rail;

a belt engaged over the pair of pulleys and having part thereof linked with the measurement block; and means linked to a rotary shaft of one of the paired pulleys for measuring the number of revolutions of the pulley and converts the number of revolutions into a moving distance of the measurement block and then outputting the moving distance.

2. The book binding system according to claim 1, characterized in that an abutting surface of the reference block and an abutting surface of the measurement block each are a flat measurement surface, so that by sandwiching the predetermined portions of the book block and the book cover between the measurement surface of the reference block and the measurement surface of the measurement block, the size can be measured.

3. The book binding system according to claim 1, characterized in that the measuring device has a display portion for displaying the measurement value and a numeric value input portion for inputting the numeric value displayed at the display portion, or changing the numeric value and then inputting the changed numeric value, wherein before the size is measured, the measurement block is abutted against the reference block, whereupon, the numeric value zero is input through the numeric value input portion so as to perform zero-point correction.

4. The book binding system according to claim 1, characterized in that the measuring device has a display portion for displaying the measurement value and a numeric value input portion for inputting the numeric value displayed at the display portion, or changing the numeric value and then inputting the changed numeric value, wherein before the size is measured, the measurement block is abutted against the reference block, whereupon, the numeric value zero is input through the numeric value input portion, and then the measurement block is moved by the maximum moving distance, the numeric value of which is previously known, whereupon, the known numeric value is input through the numeric value input portion so as to perform the calibration of the measuring device.

5. The book binding system according to claim 1, wherein the predetermined portion of the book block comprises of a thickness of the book block and either a position of a centerline of a back portion of the book cover or a position of each side edge of the back portion; and the clamp-adjustment mechanism of the carrier mechanism and the acting-portion mechanism and the alignment mechanism of each of the processing units are adjusted so that a centerline of the book cover may agree with a centerline of a back portion of the book block.

* * * * *

UNITED STATES PATENT AND TRADEMARK OFFICE

CERTIFICATE OF CORRECTION

PATENT NO. : 6,447,230 B1
DATED : September 10, 2002
INVENTOR(S) : Takai et al.

It is certified that error appears in the above-identified patent and that said Letters Patent is hereby corrected as shown below:

Title page,
Item [73], Assignee, change "HOrizon International Inc., Shiga (JP)" to be
-- Horizon International Inc., Shiga (JP) --

Signed and Sealed this

Fifteenth Day of April, 2003

JAMES E. ROGAN
*Director of the United States Patent and Trademark Office*